US011273653B2

(12) United States Patent
Masubuchi

(10) Patent No.: US 11,273,653 B2
(45) Date of Patent: Mar. 15, 2022

(54) PRINTING APPARATUS

(71) Applicant: SEIKO EPSON CORPORATION, Tokyo (JP)

(72) Inventor: Hiroyuki Masubuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/892,394

(22) Filed: Jun. 4, 2020

(65) Prior Publication Data

US 2020/0384784 A1 Dec. 10, 2020

(30) Foreign Application Priority Data

Jun. 7, 2019 (JP) ..... JP2019-106835

(51) Int. Cl.
*B41J 2/175* (2006.01)
*B41J 11/66* (2006.01)

(52) U.S. Cl.
CPC ..... *B41J 11/663* (2013.01)

(58) Field of Classification Search
CPC ..... B41J 11/66; B41J 11/663; B41J 2/175
See application file for complete search history.

(56) References Cited

U.S. PATENT DOCUMENTS

2010/0073700 A1* 3/2010 Uematsu ..... B41J 25/308 358/1.13
2011/0216137 A1* 9/2011 Okano ..... B41J 2/175 347/86
2018/0326764 A1* 11/2018 Shinjo ..... B41J 11/66

FOREIGN PATENT DOCUMENTS

JP 2017-074741 A 4/2017
JP 2017074741 A * 4/2017

OTHER PUBLICATIONS

Hideaki, Machine Translation of JP 2017-074741 A, 2017 (Year: 2017).*

* cited by examiner

*Primary Examiner* — Scott A Richmond
(74) *Attorney, Agent, or Firm* — Workman Nydegger

(57) ABSTRACT

A printing apparatus includes a transport roller that transports the recording paper from a paper roll in a transport direction, a print head that ejects ink onto the recording paper, an ink supply portion that supplies the ink to the print head, a cutting mechanism that is provided downstream of the print head in the transport direction of the recording paper and that cuts the recording paper, and a control portion that controls the transport of the recording paper in a direction opposite to the transport direction in such a manner that, after the recording paper is cut, a leading end portion of the recording paper reaches a position of the print head from a position of the cutting mechanism, wherein the ink supply portion extends from a region downstream of the print head in the transport direction of the recording paper and is coupled to the print head.

6 Claims, 8 Drawing Sheets

PRINTING APPARATUS

The present application is based on, and claims priority from JP Application Serial Number 2019-106835, filed Jun. 7, 2019, the disclosure of which is hereby incorporated by reference herein in its entirety.

BACKGROUND

1. Technical Field

The present disclosure relates to a printing apparatus.

2. Related Art

To date, there are known printing apparatuses in which a cartridge as an ink storage portion is provided on a front surface of a casing. Among such printing apparatuses, there is an apparatus in which an ink flow path is provided downstream of a print head in a transport direction of a print medium (for example, refer to JP-A-2017-74741).

In addition, there is a known printing apparatus that uses continuous paper as a print medium and cuts the continuous paper with a cutting mechanism provided near a paper discharge port. In such a printing apparatus, the paper discharge port is provided downstream of the print head, and after the printed continuous paper has been cut and discharged, the continuous paper is pulled back to the print head, and the next printing is performed.

However, in such a printing apparatus that prints on continuous paper, if an ink flow path is formed downstream of the print head, the distance from the paper discharge port to the print head becomes long. For this reason, there is a possibility that the movement amount of the continuous paper to be pulled back after the discharge is increased and the processing capability of the printing apparatus is reduced.

SUMMARY

According to an aspect of the present disclosure, a printing apparatus includes a transport roller configured to pull out recording paper from a paper roll and transport the recording paper in a transport direction, a print head configured to eject ink onto the recording paper, an ink supply portion configured to supply the ink to the print head, a cutting mechanism provided downstream of the print head in the transport direction of the recording paper and configured to cut the recording paper, and a control portion configured to control the transport of the recording paper in a direction opposite to the transport direction in such a manner that, after the recording paper is cut, a leading end portion of the recording paper pulled out from the paper roll reaches a position of the print head from a position of the cutting mechanism, in which the ink supply portion extends from a region downstream of the print head in the transport direction of the recording paper and is coupled to the print head.

The printing apparatus may further include a carriage configured to have the print head mounted thereon and move along a carriage shaft, a first support member configured to support one end of the carriage shaft, and a second support member configured to support another end of the carriage shaft, in which the ink supply portion includes a first supply pipe extending from a first ink housing portion via the first support member, a second supply pipe extending from a second ink housing portion via the second support member, a coupling member provided at the second support member and coupled to the first supply pipe and the second supply pipe, and a third supply pipe extending from the coupling member to the print head.

In the printing apparatus, the third supply pipe may be flexible and may be configured to be bent and deformed in accordance with movement of the print head.

In the printing apparatus, the third supply pipe may be provided between the first support member and the second support member.

The printing apparatus may further include a lower case configured to cover the first support member and the second support member below, in which an absorber configured to absorb the ink is provided between the first support member and the lower case, and between the second support member and the lower case.

The printing apparatus may further include a tray configured to receive the recording paper cut by the cutting mechanism, in which the tray is provided between the first ink housing portion and the second ink housing portion.

DESCRIPTION OF EXEMPLARY EMBODIMENTS

Below, a preferred embodiment of the disclosure will be described with reference to the drawings. Further, the embodiment described below does not limit the content of the present disclosure described in the claims. In addition, all of the configurations described below are not necessarily essential components of the disclosure.

Figure 1:
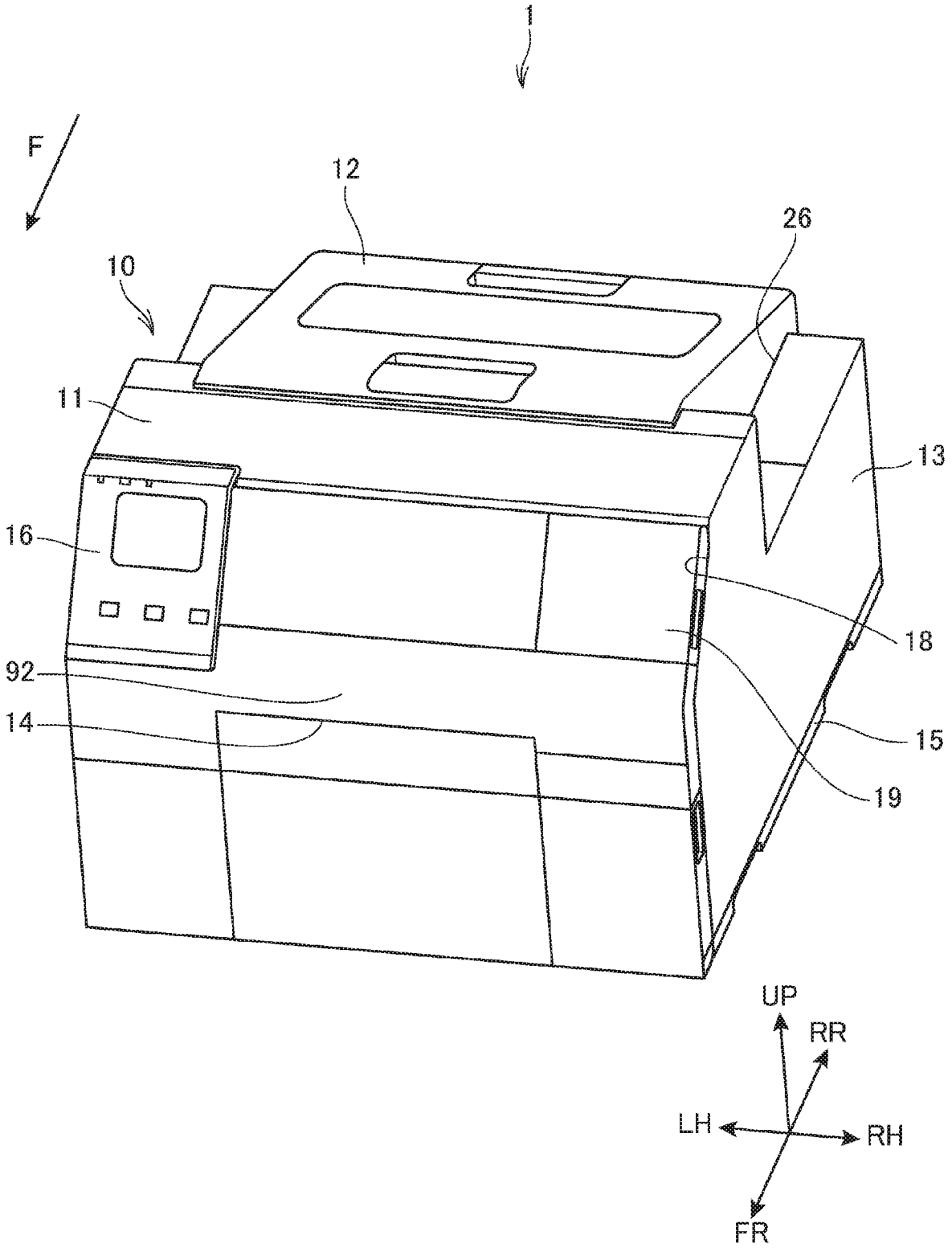
FIG. 1 is a perspective view illustrating a configuration of a printing apparatus.
Figure 2:
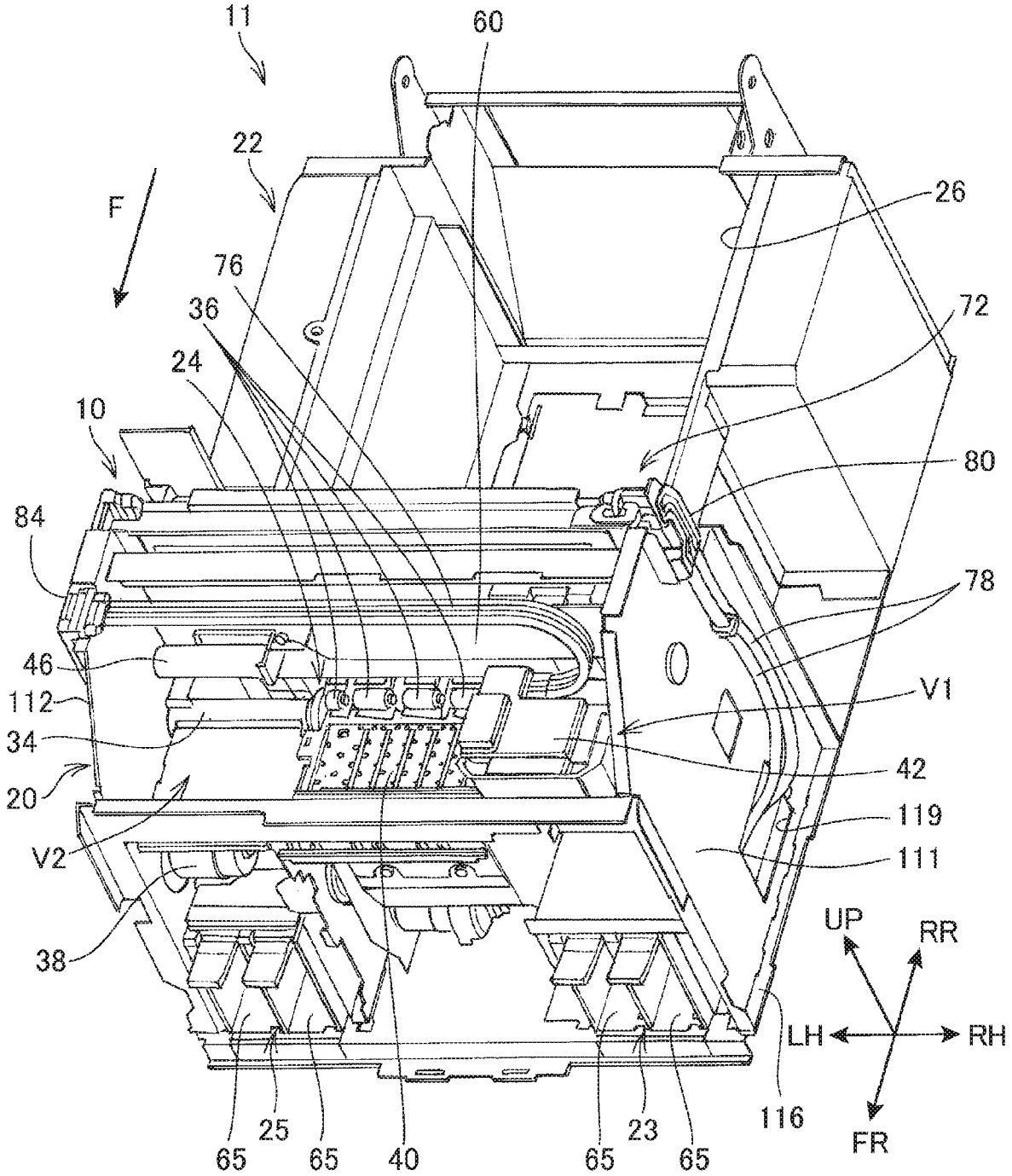
FIG. 2 is a perspective view of a mechanism portion main body.
Figure 3:
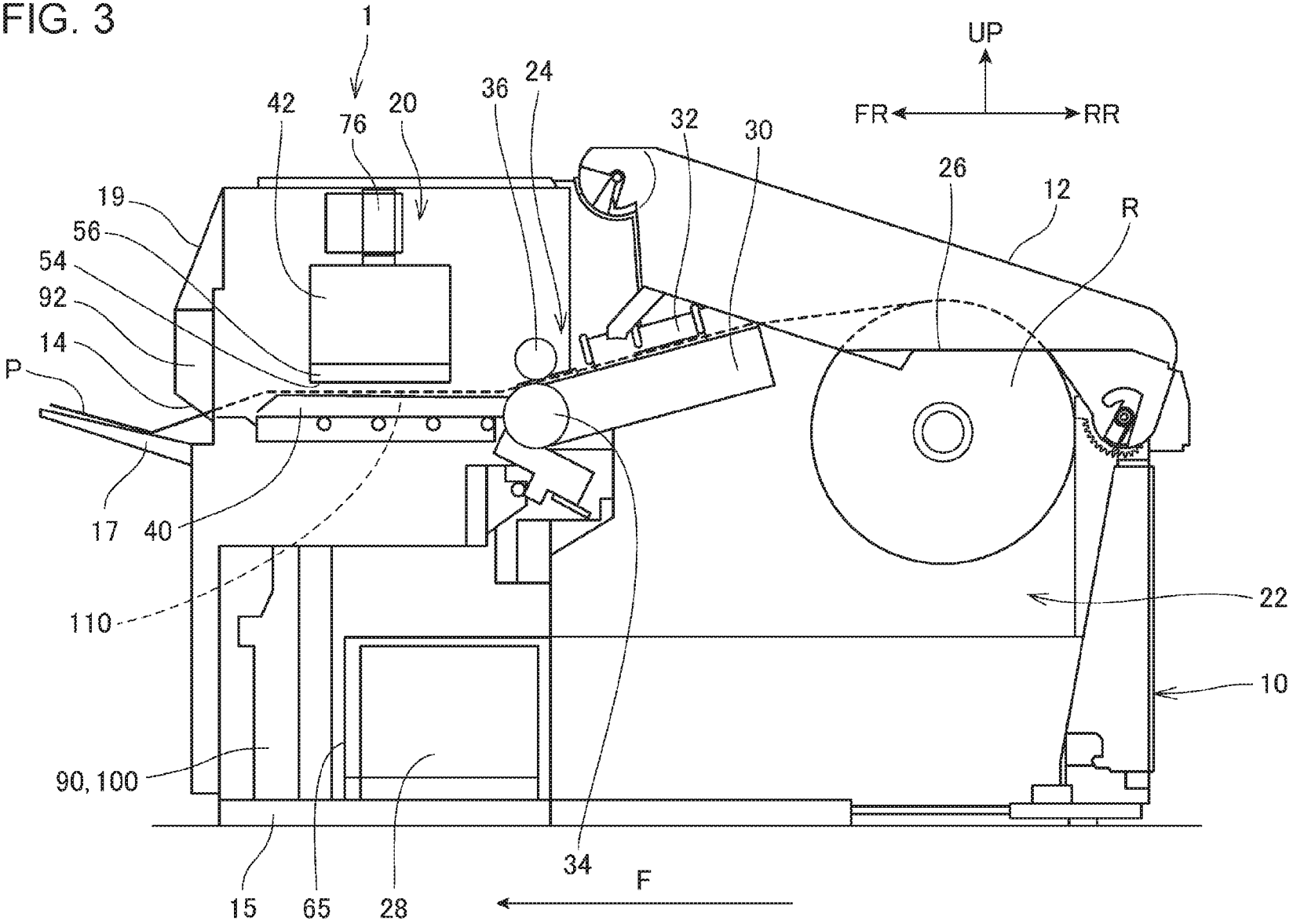
FIG. 3 is a side view illustrating a schematic configuration of the inside of the printing apparatus in which a paper roll has been loaded.

FIG. 1 is a perspective view illustrating a configuration of a printing apparatus 1 according to an embodiment, and FIG. 2 is a perspective view of a mechanism portion main body 11. FIG. 3 is a side view illustrating a schematic configuration of the inside of the printing apparatus 1 in which the paper roll R has been loaded. Further, in FIG. 1, a paper discharge tray 17 is omitted, and in FIG. 2, a top plate frame 114 is omitted.

In FIGS. 1 and 2, and in each of the drawings described below, reference sign FR indicates the front of the printing apparatus 1, reference sign RR indicates the rear of the printing apparatus 1, reference sign LH indicates the left-hand side of the printing apparatus 1, reference sign RH indicates the right-hand side of the printing apparatus 1, and reference sign UP indicates the upper side of the printing apparatus 1. In FIG. 1, the paper discharge tray 17 is omitted.

The printing apparatus 1 is a printer that prints on a print medium, and, in the present embodiment, is a label printer that uses, as the print medium, continuous paper P such as label paper in which labels are attached at regular intervals to a long piece of backing paper. Further, the print medium may be described as recording paper.

As illustrated in FIG. 1, the printing apparatus 1 includes an apparatus case 10, which has a rectangular parallelepiped shape and forms a casing of the printing apparatus 1, and a housing portion cover 12.

As illustrated in FIGS. 1 and 2, the apparatus case 10 includes the mechanism portion main body 11 of the printing apparatus 1 and an exterior panel 13 that covers the mechanism portion main body 11. The exterior panel 13 is formed by combining side panels, a front panel, and the like that cover each surface of the mechanism portion main body 11, and forms an outer shell of the printing apparatus 1.

The mechanism portion main body 11 housed in the exterior panel 13 is formed by combining a plurality of frames.

A bottom portion of the apparatus case 10 is formed of a lower case 15 that covers the bottom portion of the mechanism portion main body 11. In the center of a front surface of the apparatus case 10, a paper discharge port 14 that is slit-shaped and through which the printed continuous paper P is discharged is provided.

As illustrated in FIG. 3, on the front surface of the apparatus case 10, an automatic cutter unit 92, which is a cutting mechanism for cutting the printed continuous paper P, is provided. The automatic cutter unit 92 is disposed above the paper discharge port 14.

The automatic cutter unit 92 cuts, at a preset location, the continuous paper P that has been printed on and discharged to the outside from the paper discharge port 14. Further, the automatic cutter unit 92 may be a unit that cuts a portion of the continuous sheet P in the width direction or may be a unit that completely cuts the continuous sheet P.

On the front surface of the apparatus case 10, an operation panel 16 provided with operation buttons, a display screen, and the like is provided at a location located on the upper left side of the apparatus case 10.

On the front surface of the apparatus case 10, a front surface opening portion 18 is provided on the right-hand RH side of the operation panel 16.

The front surface opening portion 18 is adjacent to the operation panel 16, and the front surface opening portion 18 allows the outside and inside of the apparatus case 10 to communicate with each other.

The front surface opening portion 18 is closed by a detachable flat-plate-shaped cover member 19.

The paper discharge tray 17 on which continuous paper P that has been printed on and cut is stacked is provided below the paper discharge port 14.

As illustrated in FIGS. 2 and 3, the apparatus case 10 includes a printing portion 20 that prints on the continuous paper P, a housing portion 22 that houses the continuous paper P, and a transport portion 24 that transports the continuous paper P from the housing portion 22 to the printing portion 20.

In the apparatus case 10, the printing portion 20 is provided at the front, and the housing portion 22 is provided to the rear of the printing portion 20. The transport portion 24 is provided between the printing portion 20 and the housing portion 22 in the front-rear direction of the apparatus case 10.

As described above, the printing portion 20 is provided at an upper front portion of the apparatus case 10 and communicates with the outside of the apparatus case 10 via the front surface opening portion 18.

The printing portion 20 includes a platen 40 as illustrated in FIGS. 2 and 3.

The platen 40 is provided on the mechanism portion main body 11 such that an upper surface is substantially horizontal in the installation state and use state of the printing apparatus 1. The platen 40 is disposed below the printing portion 20 and supports the continuous paper P from below. The platen 40 is provided at least over the entire printing range of the printing portion 20.

A carriage shaft 46 has one end supported on an inner side surface of a first frame 111 forming a right-hand RH side surface of the printing portion 20 in the mechanism portion main body 11, has another end supported on the inner side surface of a second frame 112 forming a left-hand LH side surface of the printing portion 20, and is disposed above the platen 40. The length of the carriage shaft 46 is longer than the width of the platen 40 in the left-right direction.

Further, the one end of the carriage shaft 46 need not be directly supported by the first frame 111, and the other end of the carriage shaft 46 need not be directly supported by the second frame 112. For example, a support mechanism that supports one end of the carriage shaft 46 may be separately attached to the first frame 111, and a support mechanism that supports the other end of the carriage shaft 46 may be separately attached to the second frame 112. At least, the first frame 111 is provided at one end (one end side) of the carriage shaft 46, and the second frame 112 is provided at the other end (other end side) of the carriage shaft 46. The first frame 111 is an example of a first support member, and the second frame 112 is an example of a second support member.

A carriage 42 is attached to the carriage shaft 46. Specifically, the carriage 42 is coupled to the carriage shaft 46 on a rear surface, and is supported so as to reciprocate along the carriage shaft 46.

A head housing portion 56 that houses a print head 54 is provided on a lower portion of the carriage 42.

The print head 54 is provided in the head housing portion 56 and is disposed at a position facing the platen 40 with the continuous paper P interposed therebetween.

The carriage 42 can be reciprocally scanned by a drive mechanism using a carriage drive motor 49 (FIGS. 4 and 6) as a power source. The carriage drive motor 49 is provided at a location adjacent to an inner side surface of the first frame 111, and a drive pulley (not illustrated) is coupled to an output shaft of the carriage drive motor 49.

A driven pulley (not illustrated) is provided on an inner side surface of the second frame 112 at a position facing the drive pulley. A drive belt (not illustrated) is bridged between the drive pulley and the driven pulley. The drive belt is fixed to the rear surface of the carriage 42.

The drive pulley moves the drive belt in accordance with forward and reverse rotations of the carriage drive motor 49, and the carriage 42 reciprocally scans over the continuous paper P as the drive belt moves.

On the rear surface of the carriage 42, a linear scale (not illustrated), which is a scale indicating a position of the carriage 42 in the scanning direction, and an optical detector are provided. When the optical detector moves along with the movement of the carriage 42, a slit formed in the linear scale is optically detected, and the information is transmitted to a control portion 100 provided in the printing apparatus 1.

As a result, the control portion 100 can detect the position, speed, and movement amount of the carriage 42 in the scanning direction.

The control portion 100 controls various operations of the printing apparatus 1, and, in the present embodiment, the control portion 100 is mounted, for example, as a semiconductor chip, on a control substrate 90 provided at a lower front portion of the apparatus case 10. Further, the control portion 100 may be described as a processor.

In addition, the front surface side of the linear scale is covered by a protective member 60.

In the printing portion 20, on two sides in the left-right direction of the platen 40, retreat spaces V1 and V2, which are configured to house the carriage 42, are provided. By moving the carriage 42 up to the retreat spaces V1 and V2 during printing, printing can be performed over the entirety of the continuous paper P in the width direction.

Ink is supplied to the print head 54 from an ink cartridge 28 serving as an ink storage portion. The ink cartridge 28 is disposed below the printing portion 20. The printing apparatus 1 of the present embodiment includes four ink cartridges 28, and stores cyan, magenta, yellow, and black inks respectively. That is, the print head 54 of the present embodiment can eject four colors of ink onto the continuous paper P.

The ink cartridges 28 are housed in a first ink housing portion 23 and a second ink housing portion 25 provided below the printing portion 20.

The first ink housing portion 23 and the second ink housing portion 25 are disposed on the two sides in the left-right direction with the paper discharge port 14 and the paper discharge tray 17 interposed therebetween. Specifically, the first ink housing portion 23 is disposed below the retreat space V1, and the second ink housing portion 25 is disposed below the retreat space V2.

Each of the first ink housing portion 23 and the second ink housing portion 25 is provided with two sockets 65. In each of the sockets 65, one ink cartridge 28 is detachably stored. Further, the first ink housing portion 23 and the second ink housing portion 25 may be described as the first ink cartridge holder and the second ink cartridge holder, respectively.

Thus, the apparatus case 10 can fit the four ink cartridges 28 within the width of the retreat spaces V1 and V2 in the left-right direction. Therefore, the size of the apparatus case 10 can be reduced.

In addition, the front surface of each of the ink cartridges 28 can be exposed to the outside by removing the exterior panel 13 on the front surface side. Therefore, replacement of the ink cartridge 28 and maintenance work of the first ink housing portion 23 and the second ink housing portion 25 are easy.

Figure 4:
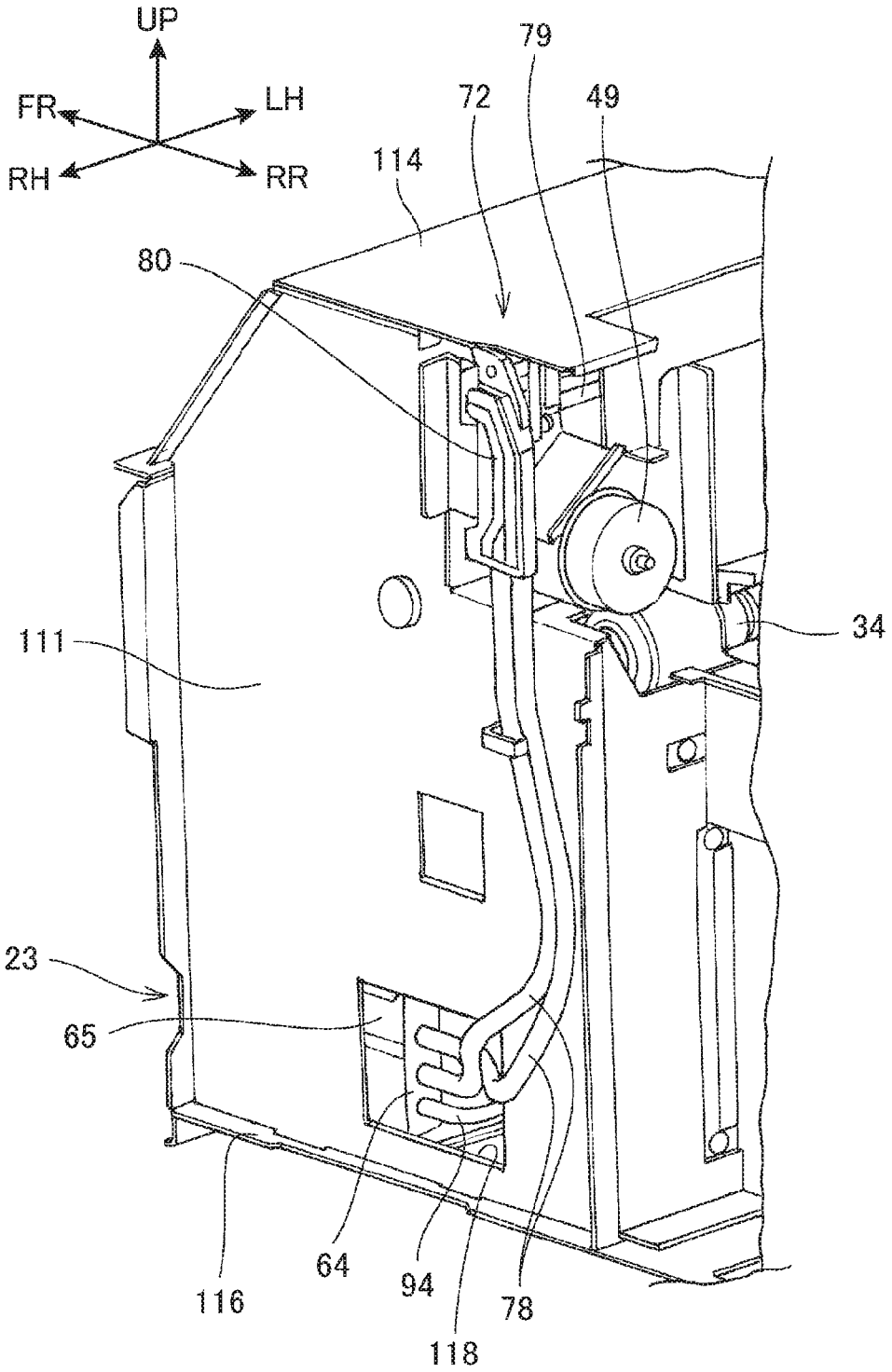
FIG. 4 is a perspective view of the mechanism portion main body when a printing portion is viewed from a first frame side.
Figure 5:
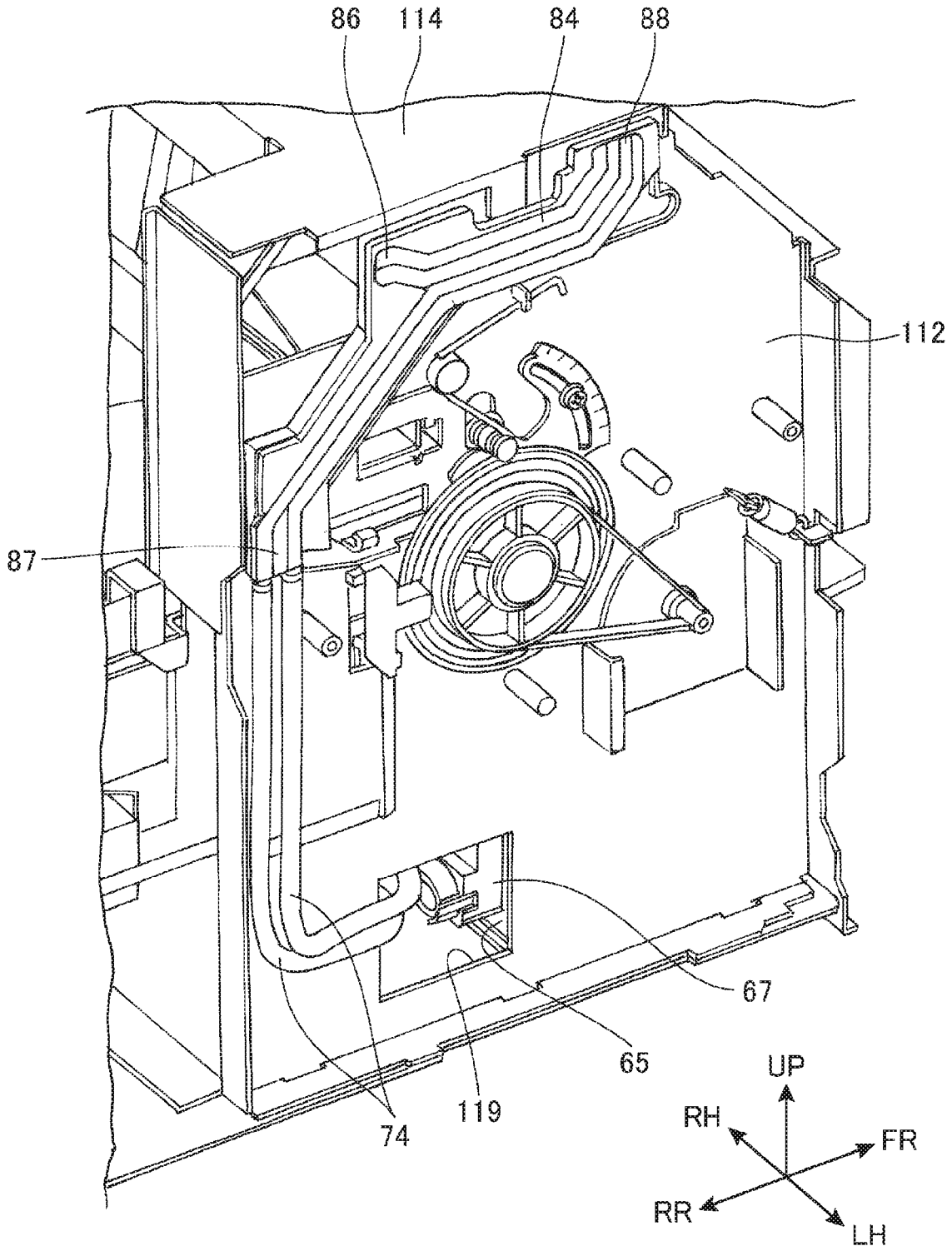
FIG. 5 is a perspective view of the mechanism portion main body when the printing portion is viewed from a second frame side.

FIG. 4 is a perspective view of the mechanism portion main body 11 when the printing portion 20 is viewed from the first frame 111 side, and FIG. 5 is a perspective view of the mechanism portion main body 11 when the printing portion 20 is viewed from the second frame 112 side.

As illustrated in FIGS. 4 and 5, a coupling portion 67 for taking out ink from each of the ink cartridges 28 is provided on the rear surface of each of the sockets 65. The coupling portion 67 couples each of the ink cartridges 28 and an ink supply portion 70 to each other. In addition, a pressurizing tube 94 is coupled to the coupling portion 67.

The pressurizing tube 94 couples a pressurizing portion (not illustrated) and the coupling portion 67 to each other. The pressurizing portion sends compressed air to each of the ink cartridges 28 via the pressurizing tube 94, and the compressed air sends the ink stored in the ink cartridge 28 to the ink supply portion 70.

Next, the ink supply portion 70 will be described.

Figure 6:
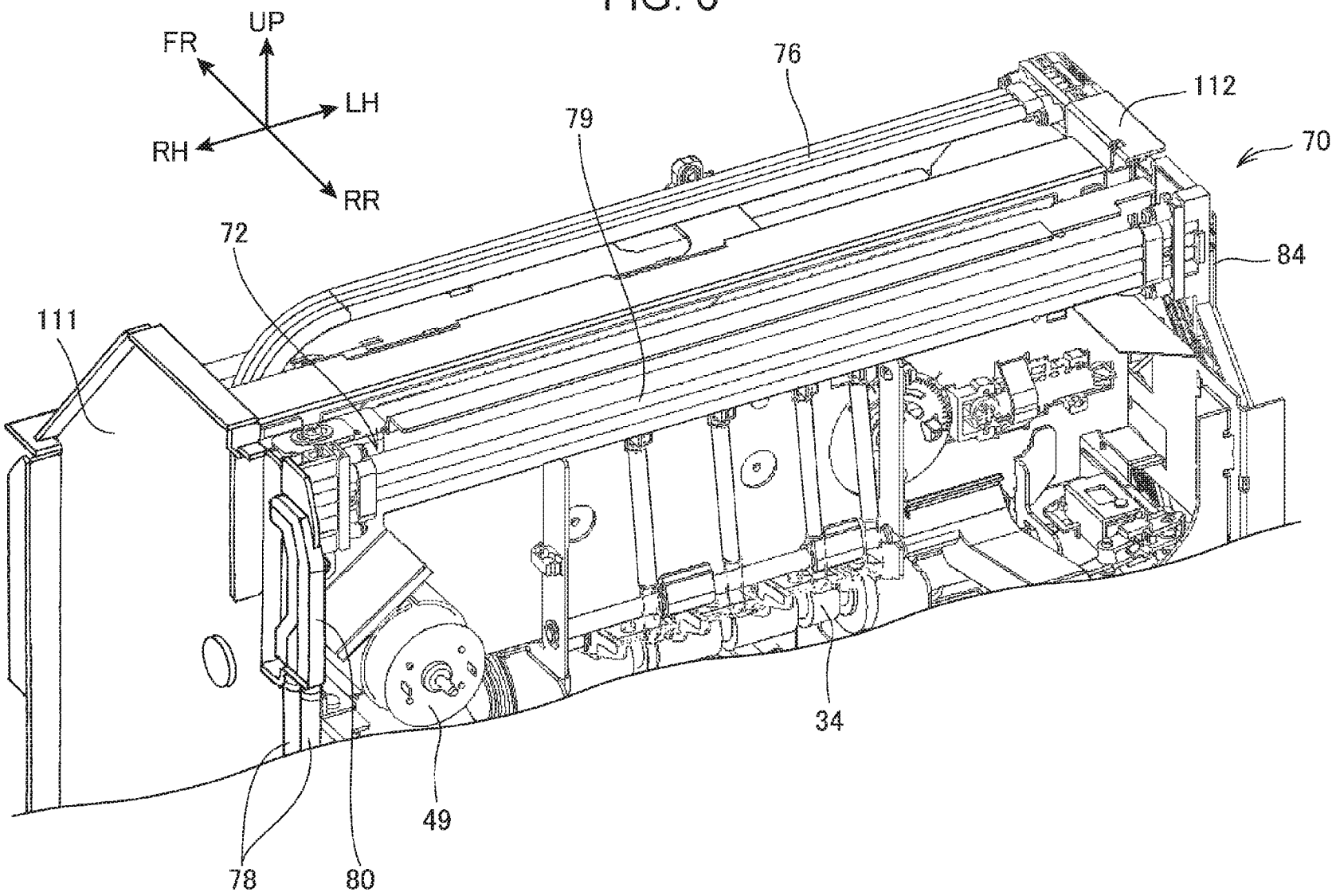
FIG. 6 is a perspective view of the mechanism portion main body when the printing portion is viewed from the rear.

FIG. 6 is a perspective view of the mechanism portion main body 11 when the printing portion 20 is viewed from the rear. In FIG. 6, the illustration of the top plate frame 114 is omitted.

The ink inside each of the ink cartridges 28 is supplied to the print head 54 via the ink supply portion 70.

As illustrated in FIGS. 4, 5, and 6, the ink supply portion 70 includes a first supply pipe 72 (first supply pipe), which is an ink flow path of the first ink housing portion 23, a second supply pipe 74 (second supply pipe), which is an ink flow path of the second ink housing portion 25, and a third supply pipe 76 (third supply pipe) coupled to the print head 54. Further, the ink supply portion may be described as an ink supply pipe.

The first supply pipe 72 includes a side surface supply pipe 78 (first-frame-side supply pipe), a central supply pipe 79, and a coupling member 80. The side surface supply pipe 78 is a combination of two ink tubes through which the inks of the two ink cartridges 28 housed in the first ink housing portion 23 flow, and one end portion of the side surface supply pipe 78 is coupled to the coupling portion 67 of the first ink housing portion 23. The side surface supply pipe 78 coupled to the coupling portion 67 is drawn out from the inside of the mechanism portion main body 11 to the outside via a first communication opening 118 provided below the first frame 111.

The width of the first communication opening 118 is such that a user can insert his or her hand into the first communication opening 118 and perform maintenance such as attachment and detachment of the side surface supply pipe 78 or the like to and from the coupling portion 67 or replacement of the coupling portion 67.

The side surface supply pipe 78 drawn out of the mechanism portion main body 11 is drawn upward along the outer side surface of the first frame 111 and is coupled to one end portion of the coupling member 80 disposed to the rear of the printing portion 20 in a side view of the mechanism portion main body 11.

The coupling member 80 is disposed on substantially the same flat surface as the outer side surface of the first frame 111, and includes ink flow paths corresponding to the two ink tubes of the side surface supply pipe 78. The other end portion of the coupling member 80 is coupled to the central supply pipe 79.

The central supply pipe 79 is disposed to the rear of the printing portion 20 in the mechanism portion main body 11 and extends so as to be bridged between the first frame 111 and the second frame 112. That is, the central supply pipe 79 is provided upstream of the printing portion 20 in the transport direction F.

The central supply pipe 79 has one end portion coupled to the coupling member 80, and sends the ink in the first ink housing portion 23 from the first frame 111 side to the second frame 112 side.

The other end portion of the central supply pipe 79 is coupled to a coupling member 84 provided at the second frame 112.

The second supply pipe 74 (second-frame-side supply pipe) is a combination of two ink tubes through which the inks stored in the two ink cartridges 28 housed in the second ink housing portion 25 flow. One end portion of the second supply pipe 74 is coupled to the coupling portion 67 of the second ink housing portion 25. The side surface supply pipe 78 extending from the coupling portion 67 is drawn out from the inside of the mechanism portion main body 11 to the outside via a second communication opening 119 provided below the second frame 112.

Similarly to the first communication opening 118, the width of the second communication opening 119 is such that the user can insert his or her hand into the second communication opening 119 and perform maintenance such as attachment and detachment of the second supply pipe 74 or the like to and from the coupling portion 67, or replacement of the coupling portion 67.

The second supply pipe 74 drawn out of the mechanism portion main body 11 is drawn upward along the outer side surface of the first frame 111 and coupled to the coupling member 84.

The coupling member 84 is provided at the outer side surface of the second frame 112 and extends from the rear of the printing portion 20 to a location located above the carriage 42 in a side view of the mechanism portion main body 11. The coupling member 84 includes a first coupling end 86, a second coupling end 87, and a third coupling end 88.

The central supply pipe 79 is coupled to the first coupling end 86, and the second supply pipe 74 is coupled to the second coupling end 87. That is, the first supply pipe 72 and the second supply pipe 74 are coupled by the coupling member 84.

The coupling member 84 includes ink flow paths corresponding to the respective ink tubes provided in the central supply pipe 79 and the second supply pipe 74. Each of the inks flowing into the coupling member 84 from the first coupling end 86 and the second coupling end 87 is sent to the third coupling end 88.

One end portion of the third supply pipe 76 is coupled to the third coupling end 88.

The third supply pipe 76 is a pipe in which a plurality of ink tubes formed of a flexible elastic member are bundled, and extends from the inner side surface of the second frame 112 to the first frame 111. The third supply pipe 76 is routed along the inner side surface of the top plate frame 114. That is, the third supply pipe 76 is disposed above the platen 40 and the carriage 42.

The third supply pipe 76 is bent downward in a U-shape, inserted into the carriage 42 from the upper surface of the carriage 42, and the other end portion of the third supply pipe 76 is coupled to the print head 54.

Further, the coupling member 84 may be a binding member that binds and couples the first supply pipe 72 and the second supply pipe 74, and, in this case, the third supply pipe 76 is the first supply pipe 72 and the second supply pipe 74 bundled by the coupling member 84.

As a result, because the third supply pipe 76 is disposed at a position overlapping the platen 40 and the carriage 42 in a top view of the mechanism portion main body 11, the third supply pipe 76 can be coupled to the print head 54 without increasing the width of the printing portion 20 along the transport direction F.

In addition, as described above, the third supply pipe 76 has flexibility. Thus, even when the carriage 42 performs reciprocating scanning in a state where the carriage 42 is bent in a U-shape, it is possible to suppress the ink from leaking to the outside from the coupling points at the two ends of the third supply pipe 76.

Figure 7:
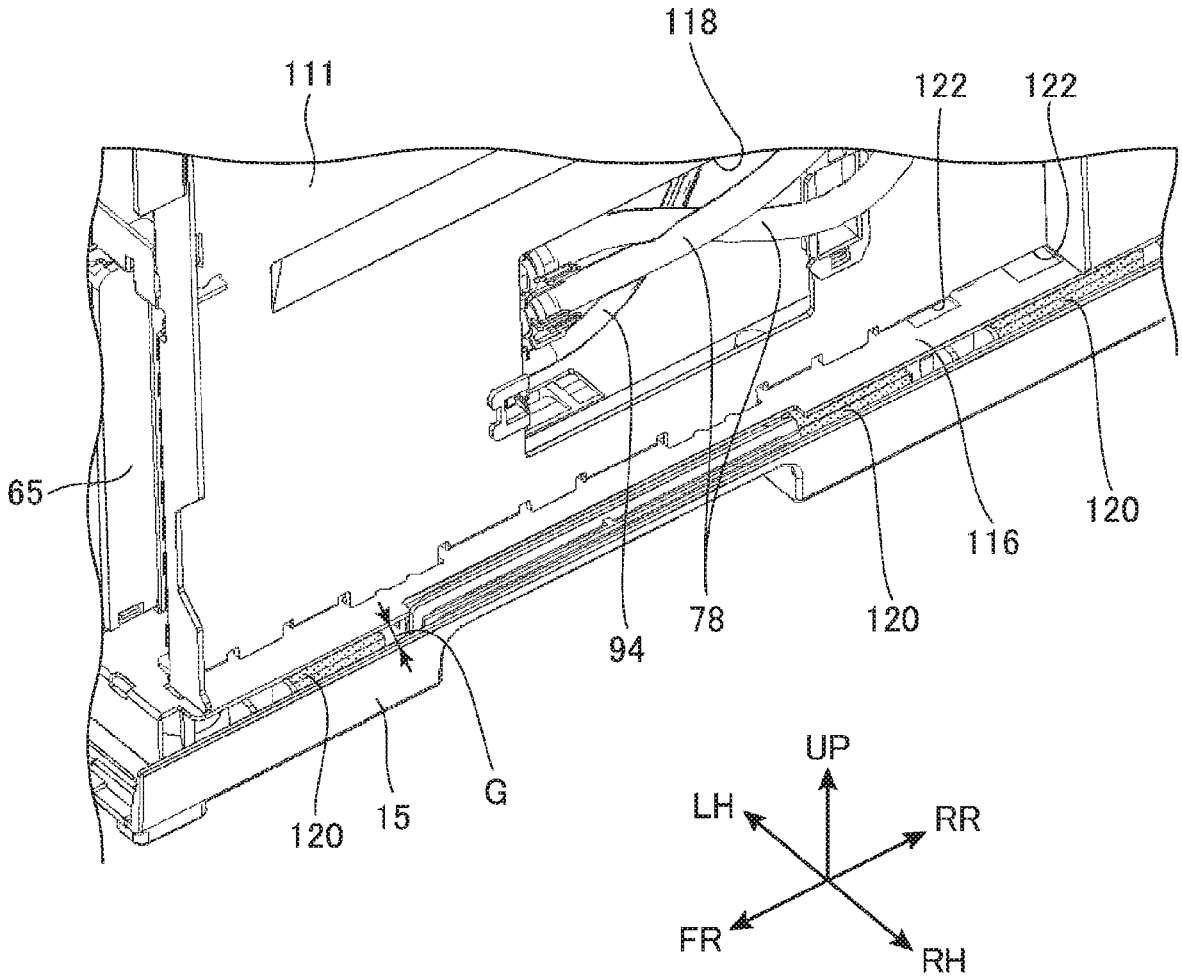
FIG. 7 is a perspective view of the mechanism portion main body and a lower case as viewed from the first frame side.
Figure 8:
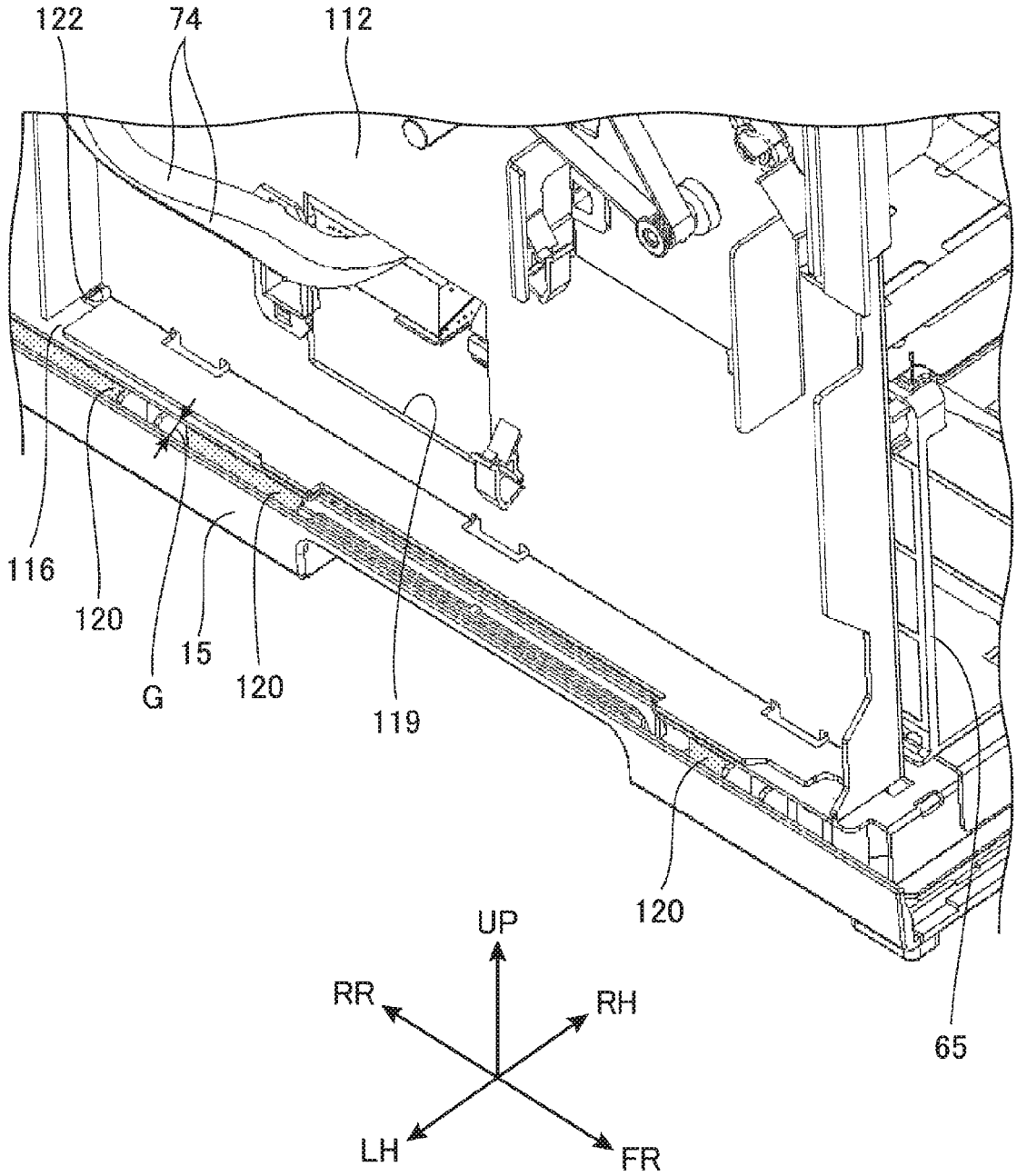
FIG. 8 is a perspective view of the mechanism portion main body and the lower case as viewed from the second frame side.

FIG. 7 is a perspective view of the mechanism portion main body 11 and the lower case 15 when viewed from the first frame 111 side, and FIG. 8 is a perspective view of the mechanism portion main body 11 and the lower case 15 when viewed from the second frame 112 side. In FIGS. 7 and 8, an absorber 120 is illustrated with dots for convenience of explanation. As illustrated in FIGS. 7 and 8, the absorber 120 configured to absorb ink is provided between a bottom plate frame 116 forming the bottom surface of the mechanism portion main body 11 and the lower case 15.

A plurality of guide holes 122 communicating with the absorber 120 are provided in the bottom plate frame 116 at locations located on the outside of the first frame 111 and the second frame 112. In addition, at locations located on the outside of the first frame 111 and the second frame 112, the bottom plate frame 116 and the outer edge of the lower case 15 are disposed with gaps G therebetween. These gaps G communicate with the absorber 120.

As described above, the side surface supply pipe 78 and the coupling member 80, and the second supply pipe 74 and the coupling member 84 are respectively coupled on the outer side surfaces of the first frame 111 and the second frame 112.

Accordingly, when inks leak from these coupling points, these inks can be transmitted on the outer side surface of the first frame 111 or the outer side surface of the second frame 112 and can be guided to the absorber 120 through the guide holes 122 and the gaps G. That is, the inks leaking from these coupling points flow into the gaps between the first frame 111, the second frame 112, and the exterior panel 13 and avoid the electric circuit and the driving mechanism of the printing apparatus 1, and are then absorbed by the absorber 120. For this reason, malfunction of the printing apparatus 1 due to leaked ink can be suppressed.

In addition, as described above, both the side surface supply pipe 78 and the coupling member 80 are disposed on the outer side surface of the first frame 111, and the second supply pipe 74 and the coupling member 84 are disposed on the outer side surface of the second frame 112. For this reason, work such as replacement or repair of these members can be easily performed by merely removing the exterior panel 13 without having to remove each frame forming the mechanism portion main body 11, the drive mechanism, and the like.

The housing portion 22 houses the continuous paper P as described above. In the present embodiment, a paper roll R obtained by winding the continuous paper P in a roll is housed inside the housing portion 22. Further, the continuous paper P is not limited to the paper roll R, and various types of paper may be used. For example, fanfold paper folded along perforations provided at intervals in the longitudinal direction of the paper may be used. In addition, for example, cut paper cut to a predetermined width may be used.

A housing opening 26 for housing the paper roll R in the housing portion 22 is provided on the upper surface of the housing portion 22.

The housing opening 26 is closed by the housing portion cover 12. The housing portion cover 12 is provided on the apparatus case 10 so as to be openable and closable.

The transport portion 24 is loaded with one end of the continuous paper P that has been pulled out.

The transport portion 24 includes a paper guide member 30, a paper presser 32, a transport roller 34, a plurality of paper feed driven rollers 36, and a transport motor 38.

The paper guide member 30 is a base that supports the continuous paper P from below, and the paper presser 32 is a member that is located above the continuous paper P so as to face the paper guide member 30 and that suppresses the continuous paper P from rising. As described above, one end of the continuous paper P that has been pulled out is loaded between the paper guide member 30 and the paper presser 32.

The transport roller 34 is disposed so that its longitudinal direction is along the scanning direction of the carriage 42 and is provided so as to be rotatable. The plurality of paper feed driven rollers 36 are disposed along the longitudinal direction of the transport roller 34 so as to be rotatable. The peripheral surface of each of the paper feed driven rollers 36 is urged against and pressed against the peripheral surface of the transport roller 34.

The transport roller 34 and each of the paper feed driven rollers 36 are disposed opposite the paper guide member 30 and the paper presser 32, respectively.

The transport motor 38 is a driving apparatus that drives the transport roller 34 to rotate. When the transport motor 38 is driven, the transport roller 34 is driven to rotate, and each of the paper feed driven rollers 36 is driven to rotate. Thus, the continuous paper P loaded between the paper guide member 30 and the paper presser 32 is interposed between the transport roller 34 and each of the paper feed driven rollers 36, and is transported to the printing portion 20 with the rotation of the transport roller 34.

The transport direction F of the continuous paper P is perpendicular to the scanning direction of the carriage 42.

The printing apparatus 1 transports the continuous paper P by the motive power of the transport motor 38, and moves the carriage 42 by the carriage drive motor 49, thereby moving the print head 54 with respect to the printing surface of the continuous paper P. By ejecting ink from the print head 54 in accordance with this movement, printing is performed on the continuous paper P.

The entire printed portion of the printed continuous paper P is discharged to the outside from the paper discharge port 14, and the rear end of the printed portion is cut by the automatic cutter unit 92. The cut continuous paper P is stacked on the paper discharge tray 17.

Thereafter, the leading end of the cut portion of the continuous paper P is pulled back to the position of the print head 54, and the next printing is performed. In other words, the control portion 100 performs control to transport the continuous paper P in a direction opposite to the transport direction F in such a manner that the leading end of the continuous paper P pulled out from the paper roll R after the continuous paper P has been cut goes from the position of the automatic cutter unit 92, which is a cutting mechanism, to the position of the print head 54.

As described above, the first supply pipe 72 is disposed from one side surface of the printing portion 20 to the rear, that is, upstream in the transport direction F, and the second supply pipe 74 is disposed on the other side surface of the printing portion 20. In addition, the first supply pipe 72 and the second supply pipe 74 are coupled by the coupling member 84 on the side surface of the printing portion 20. Furthermore, the third supply pipe 76 is disposed above the platen 40 and the carriage 42, and is coupled to the print head 54 by being bent downward.

Accordingly, the width of the printing portion 20 in the transport direction F is reduced, and the moving distance when the continuous paper P is printed and cut is reduced. For this reason, the processing capability of the printing apparatus 1 can be improved.

According to the above-described embodiment, the following effects can be obtained.

The printing apparatus 1 of this embodiment includes the ink supply portion 70 that supplies ink from the ink cartridge 28 to the print head 54. The ink supply portion 70 includes the first supply pipe 72 extending from the first frame 111 side, the second supply pipe 74 extending from the second frame 112 side, the coupling member 84, and the third supply pipe 76 extending from the coupling member 84 to the print head 54. The central supply pipe 79, which is a portion of the first supply pipe 72, is provided upstream of the print head 54 in the transport direction F of the continuous paper P.

Accordingly, the width of the printing portion 20 in the transport direction F is reduced, and the transport distance when the continuous paper P is printed and cut is reduced. For this reason, the processing capability of the printing apparatus 1 can be improved.

In addition, according to the present embodiment, the third supply pipe 76 is a flexible pipe that can be bent and deformed in accordance with the movement of the print head 54. Thus, the third supply pipe 76 is bent downward in a U-shape and can be coupled to the print head 54. In addition, even when the carriage 42 performs reciprocal scanning, it is possible to prevent the ink from leaking to the outside from coupling points at both ends of the third supply pipe 76.

In addition, according to the present embodiment, the third supply pipe 76 is provided between the first frame 111 and the second frame 112. Thus, the size of the printing portion 20 can be reduced.

In addition, according to the present embodiment, the printing apparatus 1 includes the lower case 15 that covers a lower portion of the mechanism portion main body 11, and the absorber 120 that can absorb ink is provided between the first frame 111 and the second frame 112 and the lower case 15. Accordingly, when ink leaks from the coupling point between the side surface supply pipe 78 and the coupling member 80 and the coupling point between the second supply pipe 74 and the coupling member 84, the ink can be guided to the absorber 120 via the outer side surfaces of the first frame 111 and the second frame 112.

In addition, according to the present embodiment, the printing apparatus 1 includes the automatic cutter unit 92 that cuts the continuous paper P provided downstream of the print head 54 in the transport direction F of the continuous paper P. Accordingly, because the distance between the printing portion 20 and the automatic cutter unit 92 is short, and the transport distance of the continuous paper P is short, the processing capability of the printing apparatus 1 can be improved.

In addition, according to the present embodiment, the printing apparatus 1 includes the paper discharge tray 17 that receives the continuous paper P cut by the automatic cutter unit 92. In addition, the printing apparatus 1 includes the first ink housing portion 23 that couples the ink cartridge 28 and the first supply pipe 72, and the second ink housing portion 25 that couples the ink cartridge 28 and the second supply pipe 74. Then, the paper discharge tray 17 is provided between the first ink housing portion 23 and the second ink housing portion 25 when the printing apparatus 1 is viewed from the front. Thus, the apparatus case 10 can house the four ink cartridges 28 within the width of the retreat spaces V1 and V2 in the left-right direction, and the size of the apparatus case 10 can be reduced.

The above embodiment is an example of one embodiment of the present disclosure, and can be arbitrarily modified and applied without departing from the spirit of the present disclosure.

For example, on the front side of the apparatus case 10, a winding portion for winding the continuous paper P discharged from the paper discharge port 14 below the paper discharge port 14, or a peeler for winding the release paper while removing the label from the release paper may be attached.

In addition, for example, a portion or the whole of the first supply pipe 72, the second supply pipe 74, and the third supply pipe 76 may be formed by a bellows-like pipe.

What is claimed is:

1. A printing apparatus comprising:

a transport roller configured to pull out recording paper from a paper roll and transport the recording paper in a transport direction;

a print head configured to eject ink onto the recording paper;

a first ink housing portion provided at a first side of the print head in a direction perpendicular to the transport direction and configured to house an ink cartridge from a front side;

a second ink housing portion provided at a second side of the print head in the direction perpendicular to the transport direction and configured to house an ink cartridge from the front side;

a first supply pipe extending from the first ink housing portion to the print head;

a second supply pipe extending from the second ink housing portion to the print head;

a cutting mechanism provided downstream of the print head in the transport direction of the recording paper and configured to cut the recording paper; and a control portion configured to control the transport roller to transport the recording paper in a direction opposite to the transport direction after cutting the recording paper by the cutting mechanism, wherein the first supply pipe is configured to:

pass, from the first side to the second side, through a region upstream of the print head, be coupled to the second supply pipe at the second side, and extend from the second side to the print head.

2. The printing apparatus according to claim 1, further comprising:

a carriage configured to have the print head mounted thereon and move along a carriage shaft;

a first support member configured to support one end of the carriage shaft; and a second support member configured to support another end of the carriage shaft, wherein the ink supply portion includes the first supply pipe extending from the first ink housing portion via the first support member, the second supply pipe extending from the second ink housing portion via the second support member, a coupling member provided at the second support member and coupled to the first supply pipe and the second supply pipe, and a third supply pipe extending from the coupling member to the print head.

3. The printing apparatus according to claim 2, wherein the third supply pipe is flexible and is configured to be bent and deformed in accordance with movement of the print head.

4. The printing apparatus according to claim 2, wherein the third supply pipe is provided between the first support member and the second support member.

5. The printing apparatus according to claim 2, further comprising a lower case configured to cover the first support member and the second support member below, wherein an absorber configured to absorb the ink is provided between the first support member and the lower case, and between the second support member and the lower case.

6. The printing apparatus according to any claim 2, further comprising a tray configured to receive the recording paper cut by the cutting mechanism, wherein the tray is provided between the first ink housing portion and the second ink housing portion.

* * * * *